US009593467B2

(12) United States Patent
Kajita et al.

(10) Patent No.: US 9,593,467 B2
(45) Date of Patent: Mar. 14, 2017

(54) ENGINE-ASSIST DEVICE AND INDUSTRIAL MACHINE

(71) Applicant: CATERPILLAR SARL, Geneva (CH)

(72) Inventors: Shigeo Kajita, Tokyo (JP); Kouji Kishida, Tokyo (JP); Shogo Tada, Tokyo (JP); Tetsuya Yoshino, Tokyo (JP); Yuya Kanenawa, Tokyo (JP); Nobuaki Matoba, Tokyo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 14/764,140

(22) PCT Filed: Jan. 17, 2014

(86) PCT No.: PCT/JP2014/050761
§ 371 (c)(1),
(2) Date: Jul. 28, 2015

(87) PCT Pub. No.: WO2014/115645
PCT Pub. Date: Jul. 31, 2014

(65) Prior Publication Data

US 2016/0002889 A1 Jan. 7, 2016

(30) Foreign Application Priority Data

Jan. 28, 2013 (JP) ..... 2013-013125

(51) Int. Cl.
*E02F 9/00* (2006.01)
*E02F 9/22* (2006.01)
(Continued)

(52) U.S. Cl.
CPC ..... *E02F 9/2246* (2013.01); *E02F 9/0841* (2013.01); *E02F 9/2066* (2013.01);
(Continued)

(58) Field of Classification Search
CPC ..... E02F 9/2246; E02F 9/2267; E02F 9/2217; E02F 9/0841; E02F 9/2278
See application file for complete search history.

(56) References Cited

U.S. PATENT DOCUMENTS 8,874,327 B2 10/2014 Ishihara et al.
2006/0179830 A1* 8/2006 Kamon ..... E02F 9/2246 60/431
(Continued)

FOREIGN PATENT DOCUMENTS

CN 101278130 A 10/2008
CN 101438064 A 5/2009
(Continued)

OTHER PUBLICATIONS

English Translation of Written Opinion and International Search Report mailed Mar. 25, 2014 from Application No. PCT/JP2014/050761.

*Primary Examiner* — Yonel Beaulieu
*Assistant Examiner* — Martin Weeks
(74) *Attorney, Agent, or Firm* — Baker & Hostetler LLP

(57) ABSTRACT

An inexpensive engine assist device capable of performing stable energy regeneration from an accumulator and a working machine on which the engine assist device is mounted are provided. A variable capacity type main pump and a variable capacity type assist pump are directly connected to an engine. A return pressure oil flowing out from a fluid pressure actuator is temporarily accumulated by a sub-accumulator and is supplied to an inlet of the assist pump, and the assist pump pressurizes the return fluid pressure oil and supplies the return fluid pressure oil to a main accumulator. A controller calculates and controls an assist pump swash plate angle, and assist starting torque or charge starting torque, and introduces a pressure-accumulated fluid discharged from the main accumulator to the inlet of the
(Continued)

assist pump or introduces a pressurized fluid discharged from an outlet of the assist pump into the main accumulator.

5 Claims, 9 Drawing Sheets

(51) Int. Cl.

| | |
|---|---|
| ***F15B 21/14*** | (2006.01) |
| ***E02F 9/20*** | (2006.01) |
| ***F04B 49/06*** | (2006.01) |
| ***F04B 49/08*** | (2006.01) |
| ***F04B 49/22*** | (2006.01) |
| ***F15B 1/02*** | (2006.01) |
| ***E02F 9/08*** | (2006.01) |

(52) U.S. Cl.

CPC ..... *E02F 9/2217* (2013.01); *E02F 9/2267* (2013.01); *E02F 9/2278* (2013.01); *E02F 9/2292* (2013.01); *E02F 9/2296* (2013.01); *F04B 49/06* (2013.01); *F04B 49/08* (2013.01); *F04B 49/22* (2013.01); *F15B 1/024* (2013.01); *F15B 21/14* (2013.01); *F04B 2203/0202* (2013.01); *F04B 2205/03* (2013.01); *F04B 2205/05* (2013.01); *F15B 2211/20507* (2013.01); *F15B 2211/20523* (2013.01); *F15B 2211/20546* (2013.01); *F15B 2211/20569* (2013.01); *F15B 2211/20576* (2013.01); *F15B 2211/212* (2013.01); *F15B 2211/30595* (2013.01); *F15B 2211/633* (2013.01); *F15B 2211/6306* (2013.01); *F15B 2211/6309* (2013.01); *F15B 2211/6652* (2013.01); *F15B 2211/7128* (2013.01); *F15B 2211/7135* (2013.01); *F15B 2211/7142* (2013.01)

(56) References Cited

U.S. PATENT DOCUMENTS

| | | | | |
|---|---|---|---|---|
| 2008/0093864 | A1* | 4/2008 | Kagoshima | B60K 6/48 290/40 A |
| 2011/0114329 | A1* | 5/2011 | Emecheta | E21B 33/0355 166/350 |
| 2012/0296510 | A1* | 11/2012 | Kawashima | B60W 10/08 701/22 |
| 2012/0304634 | A1* | 12/2012 | Ooi | E02F 9/2246 60/423 |

FOREIGN PATENT DOCUMENTS

| | | | |
|---|---|---|---|
| CN | 101981259 | A | 2/2011 |
| CN | 102203434 | A | 9/2011 |
| JP | 392/1976 | A | 1/1976 |
| JP | 63-212699 | A | 9/1988 |
| JP | 7-71409 | A | 3/1995 |
| JP | 2001-253649 | A | 9/2001 |
| JP | 2002-519597 | A | 7/2002 |
| JP | 2006-322578 | A | 11/2006 |
| JP | 2006-34092 | A | 12/2006 |
| JP | 2010-203036 | A | 9/2010 |
| JP | 2011-179457 | A | 9/2011 |
| JP | 2011-220390 | A | 11/2011 |
| JP | 2012-102881 | A | 5/2012 |

* cited by examiner

ENGINE-ASSIST DEVICE AND INDUSTRIAL MACHINE

CROSS-REFERENCE TO RELATED APPLICATIONS

The present application is a National Stage of International Patent Application No. PCT/JP2014/050761, filed Jan. 17, 2014, entitled "Engine-Assist Device and Industrial Machine" and claims the priority of Japanese Patent Application No. 2013-013125, filed on Jan. 28, 2013, the disclosures of which are incorporated herein by reference in their entirety.

TECHNICAL FIELD

The present invention relates to an engine assist device using an accumulator, and a working machine such as a hydraulic excavator on which the engine assist device is mounted.

BACKGROUND ART

As an example of energy regeneration circuits applied to a hydraulically driven working machine such as a hydraulic excavator, there is a system in which fluid pressure motors such as variable capacity type hydraulic motors are installed in an inline-state in a return fluid passage provided between a control valve and a tank, an input shaft of a fluid pressure pump such as a variable capacity type hydraulic pump is connected to an output shaft of the fluid pressure motor via a speed reducer, a supply port of a direction control valve communicates with a discharging pump of the fluid pressure pump via a check valve, one output port of the direction control valve is connected to an accumulator for accumulating pressure, and the other output port is connected to a main circuit through which an operating fluid is supplied from a main pump to a fluid pressure actuator (for example, refer to PTL 1).

In the system, the return pressure oil is supplied to the variable capacity type hydraulic motor, the variable capacity type hydraulic pump is driven, the pressure oil is pressure-accumulated in the accumulator, the pressure oil of the pressure-accumulated in the accumulator, the pressure oil of the accumulator is supplied to the main pump when an actuator is operated, and energy is regenerated.

In addition, in recent years, in a working machine such as a hydraulic excavator, a hybrid system in which a hydraulic system and an electric system are combined has been used. For example, a generator motor is provided in an engine drive portion, a generator motor is adopted for performing swivel driving, an upper swivel body is driven by the generator motor, brake energy generated when swivel braking is applied is converted into electricity, the electricity is charged into a capacitor or a battery, and accumulated power is used for the swivel driving. In addition, electricity is charged by a generator motor which is directly connected to an engine when the engine is under a light load, and power assist is performed by the generator motor using power charged during a heavy load (for example, refer to PTL 2).

CITATION LIST

Patent Literature

[PTL 1] Japanese Unexamined Patent Application Publication No. 2006-322578

[PTL 2] Japanese Unexamined Patent Application Publication No. 2006-349092

SUMMARY OF INVENTION

Technical Problem

In the energy regeneration system using the accumulator of PTL 1, when the pressure oil pressure-accumulated by the accumulator is supplied to a hydraulic actuator, since an amount of the pressure oil supplied from the accumulator changes according to a pressure accumulation state of the accumulator or a state of the main circuit, it is not possible to obtain stable energy generation.

Meanwhile, in the hybrid system of PTL 2 in which the hydraulic system and the electric system are combined, since a large capacity generator motor, a power storage device such as a capacitor or a battery, and an electrical control device for controlling these are required, cost increases. In addition, there is a problem in which the hybrid system cannot be mounted on a conventional machine through a simple modification.

The present invention is made in consideration of the above-described problems, and an object thereof is to provide an inexpensive engine assist device capable of performing stable energy regeneration by an accumulator and a working machine on which the engine assist device is mounted.

Solution to Problem

According to the present invention in claim 1, there is provided an engine assist device in which a variable capacity type main pump is driven by an engine, excess energy generated when a fluid pressure actuator which is operated by a pressurized fluid discharged from the main pump is braked is accumulated in an accumulator, and energy is regenerated in the engine, the engine assist device including: a variable capacity type assist pump which is directly connected to the engine or the main pump and has a motor function for assisting an engine and a pump function for accumulating a pressure in an accumulator; a main accumulator which accumulates a pressurized fluid discharged from the assist pump; a sub-accumulator which temporarily pressure-accumulates a return pressure oil flowing out from the fluid pressure actuator and supplies the return pressure oil to the assist pump and the main accumulator; engine speed setting means for indicating an set engine speed; an engine speed sensor for detecting an actual engine speed; a main pump pressure sensor for detecting a main pump pressure during a discharging operation of the main pump; a main pump capacity sensor which detects a variable capacity of the main pump; a main accumulator pressure sensor which detects a main accumulator pressure of the main accumulator; a sub-accumulator pressure sensor which detects a sub-accumulator pressure of the sub-accumulator; an assist pump pressure sensor which detects an assist pump discharge pressure of a fluid discharged from the assist pump; a controller which obtains an engine load torque from the main pump pressure and the capacity of the main pump, wherein when the engine load torque exceeds assist starting torque set by the engine speed setting means, the controller calculates and controls a capacity of the assist pump based on a difference in torque between the engine load torque and the assist starting torque and a differential pressure (assist pump discharge pressure may be 0 during assist) between the main accumulator pressure and the assist pump discharge pressure, and introduces a pressure-accumulated fluid discharged from the main accumulator into the assist pump, and when the engine load torque is lower than charge starting torque set by the engine speed setting means, the controller calculates and controls the capacity of the assist pump based on a difference in torque between the engine load torque and the charge starting torque and a differential pressure between the assist pump discharge pressure and the sub-accumulator pressure, and introduces a pressurized fluid discharged from the assist pump into the main accumulator.

According to the present invention in claim 2, the engine assist device according to claim 1, further includes: a main accumulator regeneration valve which is provided between the main accumulator and the assist pump, and pressurizes the pressure-accumulated fluid of the main accumulator and supplies the fluid to the assist pump by means of an opening operation; and an unloading valve which is connected to a fluid outflow side of the assist pump and is capable of opening the fluid outflow side of the assist pump with respect to an operating fluid tank by means of an opening operation; wherein the controller includes load torque calculation means for obtaining the engine load torque from the main pump pressure and the capacity of the main pump; assist control means for opening the main accumulator regeneration valve and the unloading valve and for driving the assist pump by the main accumulator pressure when the engine load torque exceeds the assist starting torque set by the engine speed setting means, and for assisting the engine by calculating and controlling the capacity of the assist pump based on the difference in torque between the engine load torque and the assist starting torque and the differential pressure (assist pump discharge pressure may be 0 during assist) between the main accumulator pressure and the assist pump discharge pressure; main pump correction means for obtaining assist torque capable of being output from the main accumulator pressure and correcting torque of the main pump when the assist torque is insufficient; and charge control means for driving the assist pump by closing the main accumulator regeneration valve and the unloading valve when the engine load torque is lower than the charge starting torque set by the engine speed setting means, and for pressure-accumulating an operating fluid in the main accumulator by calculating and controlling the capacity of the assist pump based on the difference in torque between the engine load torque and the charge starting torque and the differential pressure between the assist pump discharge pressure and the sub-accumulator pressure.

According to the present invention in claim 3, in the engine assist device according to claim 2, the engine includes a starter motor which is directly connected to the engine, and wherein the main accumulator regeneration valve and the unloading valve have a function by which the main accumulator regeneration valve and the unloading valve are opened to be interlocked with each other during starting of the starter motor.

According to the present invention in claim 4, there is provided a working machine, including: a machine body;

a working device which is mounted on the machine body; and the engine assist device according to any one of claims 1 to 3 provided in the machine body and the working device; wherein the fluid pressure actuator, the main pump, the assist pump, the main accumulator, and the sub-accumulator according to any one of claims 1 to 3 are hydraulic devices.

According to the present invention in claim 5, in the working device according to claim 4, the machine body includes a lower traveling body; and an upper swivel body which is capable of being swiveled around the lower traveling body by a hydraulic swivel motor, wherein the working device includes a hydraulic boom cylinder which moves the working device up and down, wherein the sub-accumulator in the engine assist device has a function which temporarily pressure-accumulates pressure oil discharged from a head chamber of the boom cylinder when a boom is lowered and pressure oil discharged from the swivel motor when swivel braking is applied, and wherein the sub-accumulator includes a boom head pressure accumulation check valve which enables the pressure oil of the head chamber of the boom cylinder to flow in only a direction in which the pressure oil is returned to the sub-accumulator side when the boom is lowered; a boom regeneration selector valve which is switched from a closed state to an open state to return pressure oil to the sub-accumulator via the boom head pressure accumulation check valve; a high pressure selection valve which selects a high pressure when right swivel braking and left swivel braking of the swivel motor are applied; a sequence valve which is provided on a downstream side of the high pressure selection valve and has a relief function; a swivel pressure accumulation check valve which supplies the pressure oil via the sequence valve to the sub-accumulator side; an assist pump inflow-side check valve which enables a fluid to flow from the sub-accumulator to a fluid inflow side of the assist pump; an inter-accumulator check valve which enables a fluid to flow from the sub-accumulator to the main accumulator; and an assist pump outflow-side check valve which enables pressure oil discharged from the assist pump to flow in a direction in which the pressure oil is capable of being pressure-accumulated in the main accumulator.

Advantageous Effects of Invention

According to the invention of claim 1, the variable capacity type assist pump having the motor function for assisting an engine and the pump function for accumulating pressure in the accumulator is directly connected to the engine or the main pump, and the pressurized fluid supplied to the assist pump is further pressurized by the assist pump through the sub-accumulator, which temporarily pressure-accumulates the return pressure oil flowing out from the fluid pressure actuator, so as to accumulate high fluid pressure energy in the main accumulator. When the engine load torque obtained from the main pump pressure and the variable capacity of the main pump exceeds the assist starting torque, the controller calculates a capacity of the assist pump based on the difference in torque between the engine load torque and the assist starting torque and the differential pressure (assist pump discharge pressure may be 0 during assist) between the main accumulator pressure and the assist pump discharge pressure, and controls the capacity of the assist pump. In addition, the controller pressurizes the pressure-accumulated fluid and supplies the fluid from the main accumulator to the assist pump, and drives the assist pump as a motor to assist the engine. In addition, when the engine load torque is lower than the charge starting torque, the controller calculates and controls the capacity of the assist pump based on the difference in torque between the engine load torque and the charge starting torque and a differential pressure between the assist pump discharge pressure and the sub-accumulator pressure, and pressure-accumulates the pressurized fluid supplied from the assist pump in the main accumulator. Accordingly, it is possible to provide an inexpensive engine assist device capable of performing stable energy regeneration from the main accumulator or the sub-accumulator according to a pressure-accumulation state of the main accumulator, a state of the engine load torque, or the like without using a large capacity generator motor, a large capacity power storage device, or the like. In addition, since an engine is assisted by the assist pump driven by the main accumulator pressure during a high load of the engine and the pressurized fluid stably supplied from the fluid pressure actuator via the sub-accumulator during a low load of the engine is pressure-accumulated in the main accumulator by the assist pump, a load of the engine can be averaged, fuel consumption is improved, and it is possible to decrease exhaust gas such as black smoke generated from the engine.

According to the invention of claim 2, the controller includes the assist control means for assisting the engine when the engine load torque exceeds the assist starting torque set by the engine speed setting means, the main pump correction means for correcting torque of the main pump when assist torque is not sufficient, and the charge control means for pressure-accumulating the operating fluid in the main accumulator when the engine load torque decreases, and the controller controls the assist pump and the main pump while controlling opening and closing of the main accumulator regeneration valve and the unloading valve according to the engine load torque. Accordingly, it is possible to charge the pressurized fluid, in which pressure variation is smoothed by the sub-accumulator, into the main accumulator at an appropriate timing according to a pressure accumulation state of the main accumulator, a state of the engine load torque, or the like, and it is possible to extract energy for driving the assist pump from the main accumulator or the sub-accumulator at an appropriate timing.

According to the invention of claim 3, since the main accumulator regeneration valve and the unloading valve are opened to be interlocked with each other during starting of the starter motor of the engine, when the engine starts or when the engine restarts from an idling stop state, the assist pump can function as an assist motor operated in a rotation direction of the engine by the pressurized fluid pressure-accumulated in the main accumulator. Accordingly, it is possible to decrease a load of the starter motor, reduce a size of the starter motor, decrease consumption of a battery, and decrease unpleasant gear noise generated when the starter motor is used.

According to the invention of claim 4, since the fluid pressure actuator, the main pump, the assist pump, the main accumulator, and the sub-accumulator configure a working machine of a hybrid system using a hydraulic system, as hydraulic devices, compared to a hybrid system using an electric system configured of a generator motor or a power storage device, it is possible to significantly decrease cost, decrease maintenance, and decrease running cost. In addition, the hydraulic device can be easily mounted on an existing hydraulic working machine. In addition, since it is possible to effectively recover the return pressure oil, which is discharged from the hydraulic actuator, via the sub-accumulator, it is possible to decrease loss in energy in a hydraulic device which has been discharged as heat until now, and it is possible to decrease a size of a hydraulic cooling device.

According to the invention of claim 5, the pressure oil of the head chamber of the boom cylinder is returned to the sub-accumulator side by the boom head pressure accumulation check valve and the boom regeneration selector valve when the boom is lowered and is pressure-accumulated in the main accumulator. In addition, return oil having a pressure exceeding a swivel brake pressure is temporarily recovered by the sub-accumulator and can be pressure-accumulated in the main accumulator while maintaining the swivel brake pressure generated when the right swivel braking and the left swivel braking of the swivel motor are applied, by the high pressure selection valve, the sequence valve, and the swivel pressure accumulation check valve, and it is possible to introduce a high pressure oil in the main accumulator to the assist pump in only a direction of being supplied to the assist pump by the assist pump inflow-side check valve, the inter-accumulator check valve, and the assist pump outflow-side check valve. Accordingly, it is possible pressure-accumulate pressure oil pressurized by the assist pump in the main accumulator in a high pressure state while smoothing hydraulic variation of the pressure oil discharged from the head chamber of the boom cylinder when the boom is lowered and the pressure oil discharged from the swivel motor when swivel braking is applied, it is possible to effectively recover excess energy when a load of an engine decreases and effectively use the excess energy when a load of an engine increases, and it is possible to decease energy loss of a hydraulic device. Therefore, it is possible to reduce a size of an engine, and it is possible to decrease sizes of related devices such as a cooling device or an air cleaner of an engine according to reduction in a size of an engine. In addition, it is possible to effectively perform energy regeneration even with a small assist pump using a high-pressure main accumulator and an intermediate-pressure sub-accumulator.

DESCRIPTION OF EMBODIMENTS

Hereinafter, the present invention will be described in detail based on an embodiment shown in FIGS. 1 to 10.

Figure 2:
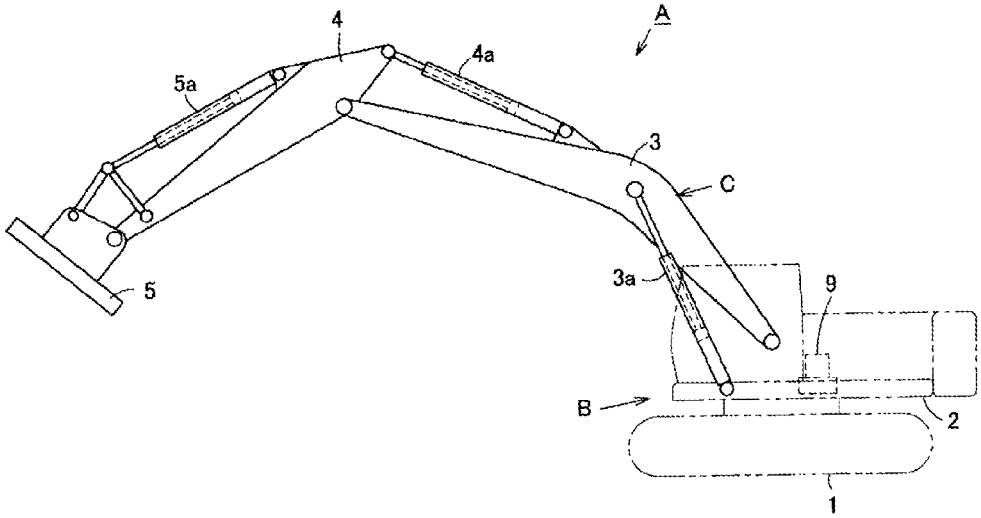
FIG. 2 is a schematic diagram showing a hydraulic excavator which is a representative of a working machine on which the assist device is mounted.

FIG. 2 shows a working machine A in which a hydraulic excavator is a base machine, and in the working machine A, a working device C is mounted on a machine body B. In the machine body B, an upper swivel body 2 is provided on a lower traveling body 1 having a hydraulic motor for traveling so as to be swiveled by a hydraulic motor for swiveling, and the working device C is mounted on the upper swivel body 2.

In the working device C, a base end of a boom 3 is pivoted to the upper swivel body 2 rotatably in a vertical direction, a boom cylinder 3*a* which is a hydraulic cylinder for rotating a boom is provided with respect to the boom 3, an arm 4 is pivoted to a tip of the boom 3 rotatably in a horizontal direction, and an arm cylinder 4*a* which is a hydraulic cylinder for rotating an arm is provided with respect to the arm 4. In addition, an attachment 5 such as an electromagnet for attaching a proprietary bucket is rotatably pivoted to a tip of the arm 4, and a bucket cylinder 5*a* which is a hydraulic cylinder for rotating an attachment is provided with respect to the attachment 5.

Figure 1:
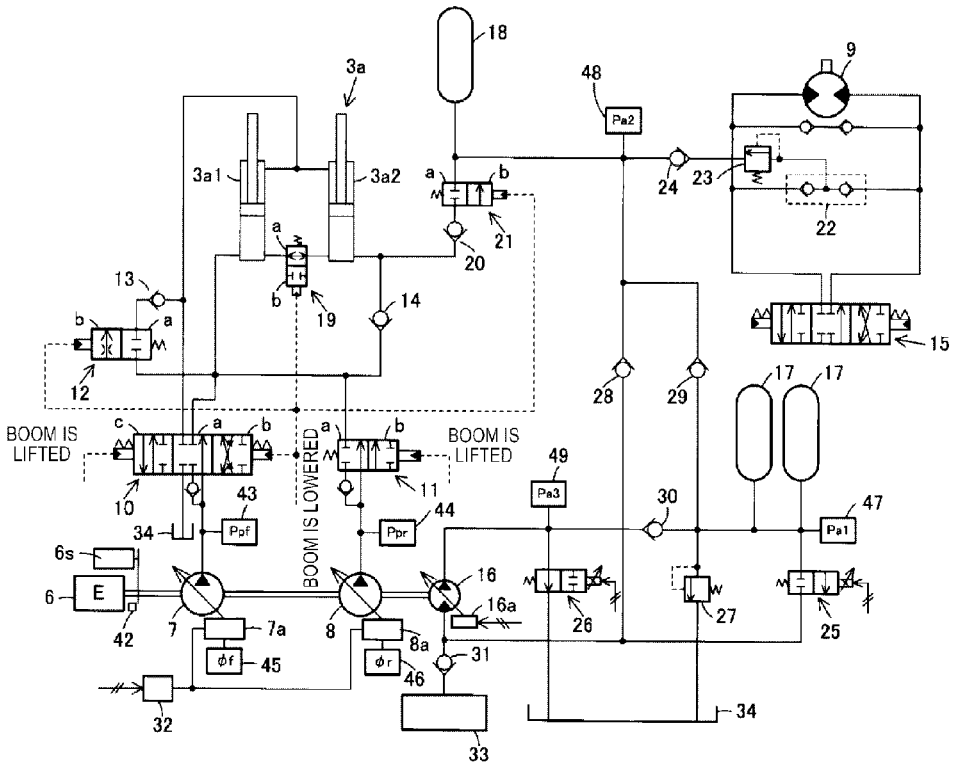
FIG. 1 is a circuit diagram showing an embodiment of an engine assist device according to the present invention.

FIG. 1 shows a hydraulic circuit which is a fluid pressure circuit of the working machine A, and variable capacity type main pumps 7 and 8 for supplying operating pressure oil serving as a pressurized fluid to fluid pressure actuators (hydraulic cylinders and hydraulic motors) of the working machine A, that is, a front pump 7 and a rear pump 8 are sequentially and directly connected to an output shaft of an engine 6 mounted on the upper swivel body 2 to drive the engine 6. A starter motor 6*s* which is driven by power supplied from an in-vehicle battery (not shown) is connected to the output shaft of the engine 6.

Each of the front pump 7 and the rear pump 8 is a variable capacity type pump including a pump swash plate for controlling a variable capacity, a swash plate angle of the pump swash plate is controlled by each of swash plate control devices 7*a* and 8*a*, and pump capacity of each of the front pump 7 and the rear pump 8 is controlled in proportion to the swash plate angle.

In FIG. 1, a swivel hydraulic motor (referred to as a swivel motor) 9 by which the upper swivel body 2 is driven so as to be swiveled with respect to the lower traveling body 1, and two boom cylinders 3*a*, that is, a first boom cylinder 3*a*1 and a second boom cylinder 3*a*2 are shown.

A suction port of each of the front pump 7 and the rear pump 8 communicates with an inner portion of a tank via a pipe (not shown), and a discharge port of each of the front pump 7 and the rear pump 8 communicates with each of the supply ports of a boom first flow rate control valve 10 and a boom second flow rate control valve 11 for operating the first boom cylinder 3*a*1 and the second boom cylinder 3*a*2.

A boom regeneration valve 12 and a backflow preventing check valve 13 which are switched by a pilot pressure for lowering a boom and return pressure oil of a head chamber of the first boom cylinder 3*a*1 to a rod chamber are provided in a regeneration passage which is provided from a head side of the first boom cylinder 3*a*1 to a rod side.

A backflow preventing check valve 14 is also provided in a passage through which the second boom flow rate control valve 11 and a head chamber of the second boom cylinder 3*a*2 communicate with each other.

A hydraulic circuit is provided, which supplies operating pressure oil from the rear pump 8 to a swivel flow rate control valve 15 which controls left swiveling, right swiveling, and stopping of the swivel motor 9. However, the hydraulic circuit is not shown in the drawings. By returning the swivel flow rate control valve 15 from right and left switched positions to a neutral position shown in FIG. 1, a swivel brake pressure is generated when right swivel braking or left swivel braking is applied.

A variable capacity type assist pump 16 having both functions of a pump and a motor is directly connected to the engine 6 or output shafts of the main pumps 7 and 8. The assist pump 16 includes a pump swash plate for controlling a variable capacity, a swash plate angle of the pump swash plate is controlled by a swash plate control device 16*a*, and pump capacity of the assist pump 16 is controlled in proportion to the swash plate angle.

A single main accumulator 17 or a plurality of main accumulators 17 for accumulating fluid pressure energy are connected to a discharge passage of the assist pump 16 while a sub-accumulator 18 for temporarily accumulating pressure oil discharged from the second boom cylinder 3*a*2 and the swivel motor 9 is provided in a passage between a head side of the second boom cylinder 3*a*2 and a driving circuit of the swivel motor 9.

A selector valve 19 which is switched by a pilot pressure for lowering the boom is provided between the head chamber of the first boom cylinder 3*a*1 and the head chamber of the second boom cylinder 3*a*2.

A boom head pressure accumulation check valve 20 for preventing leakage of pressure oil, and a boom regeneration selector valve 21 for introducing pressure oil of the head chamber of the second boom cylinder 3*a*2 which is switched from a closed state to an open state by the pilot pressure for lowering the boom to the sub-accumulator 18 side are provided in a passage from the head chamber of the second boom cylinder 3*a*2 to the sub-accumulator 18.

A high pressure selection valve (shuttle valve) 22 is provided between a left rotation port and a right rotation port of the swivel motor 9, and a sequence valve 23 for maintaining a swivel brake pressure and a swivel pressure accumulation check valve 24 for preventing backflow are provided in a passage from an outlet of the high pressure selection valve 22 to the sub-accumulator 18.

An electromagnetically operating type main accumulator regeneration valve 25, which pressurizes pressure oil pressure-accumulated in the main accumulator 17 and supplies it to an inlet side of the assist pump 16 by being switched from a closed position to an open position, is provided in a passage provided from the main accumulator 17 to the inlet of the assist pump 16.

An electromagnetically operating type unloading valve 26 which opens an outlet side of the assist pump 16 to an inner portion of a hydraulic oil tank 34 at an open position so as to control the assist pump in an unload state is provided in a drain passage provided from the outlet of the assist pump 16 to the hydraulic oil tank 34 serving as an operating fluid tank so as to be switched between an open position and a closed position.

By closing the unloading valve 26, the pressure oil discharged from the assist pump 16 is pressure-accumulated in the main accumulator 17, and by opening the unloading valve 26, pressure accumulation of the main accumulator 17 performed by the assist pump 16 is stopped or the assist pump 16 is driven as a motor by the pressure oil pressure-accumulated in the main accumulator 17.

The main accumulator regeneration valve 25 and the unloading valve 26 are opened and closed so as to perform pressure-accumulation and pressure-release of the main accumulator 17 during operation of a hydraulic device, are controlled to be open so as to be interlocked with each other when the starter motor 6*s* starts, drive the assist pump 16 as a motor by pressure oil pressure-accumulated in the main accumulator 17 when the engine 6 starts or restarts from an idling stop state, and a load applied to the starter motor 6*s* is reduced.

A relief valve 27 which sets the maximum pressure of the main accumulator 17 is provided in a drain passage provided from the main accumulator 17 to the hydraulic oil tank 34.

An assist pump inflow-side check valve 28 for supplying pressure oil from the sub-accumulator 18 to an inlet of the assist pump 16 and preventing backflow is provided in a passage provided from the sub-accumulator 18 to the inlet of the assist pump 16.

An inter-accumulator check valve 29 for supplying pressure oil from the sub-accumulator 18 to the main accumulator 17 and preventing backflow is provided in a passage provided from the sub-accumulator 18 to the main accumulator 17.

Similarly, an assist pump outflow-side check valve 30 and a check valve 31 for preventing backflow from the main accumulator 17 are provided.

In a passage between the unloading valve 26 and the relief valve 27, the assist pump outflow-side check valve 30 allows the pressure oil discharged from the assist pump 16 to flow in a direction in which the pressure oil can be pressure-accumulated in the main accumulator 17, and prevents backflow of the pressure oil flowing from the main accumulator 17 and the sub-accumulator 18 to an outlet of the assist pump 16.

Each swash plate angle of a capacity variable front pump swash plate and a capacity variable rear pump swash plate of the front pump 7 and the rear pump 8 is controlled by displacement of swash plate angle adjustment pistons of the swash plate control devices 7*a* and 8*a*. However, the piston displacement is variably controlled by a power shift control valve 32.

The power shift control valve 32 is a solenoid proportional pressure reducing valve which outputs power shift pressures corresponding to power shift control signals to the swash plate angle adjustment pistons of the swash plate control devices 7*a* and 8*a*, and adjusts torque of the front pump 7 and the rear pump 8.

A return circuit 33 and a hydraulic oil tank 34 are connected to the check valve 31 of the inlet side of the assist pump 16.

Figure 3:
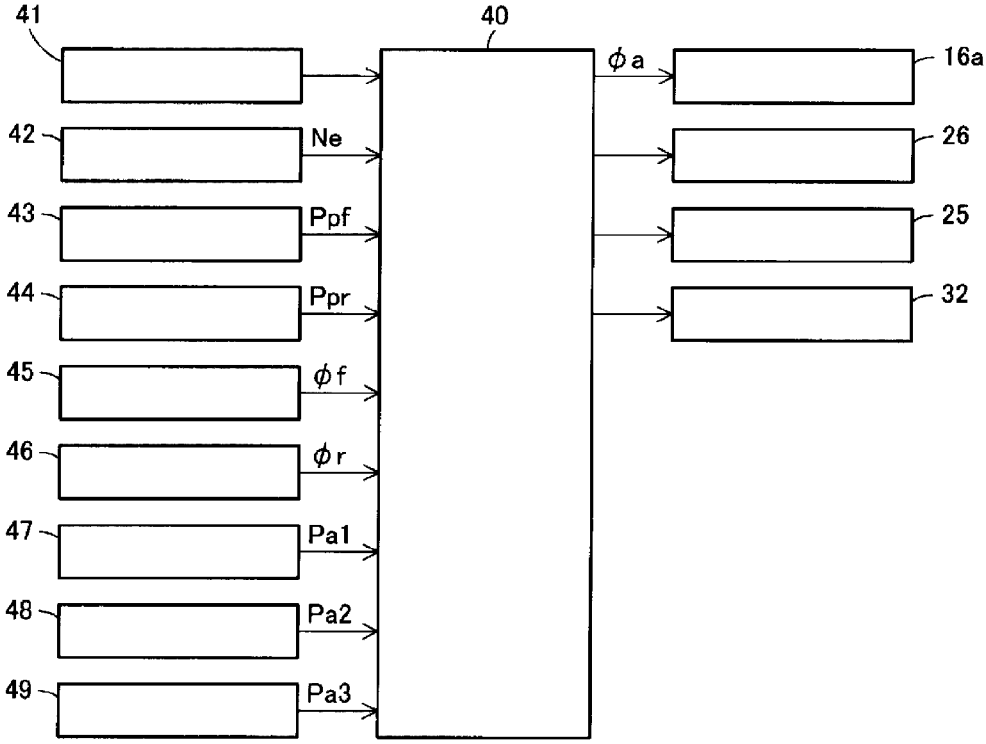
FIG. 3 is a block diagram showing inputs and outputs of a control device of the assist device.

Next, in FIG. 3, input and output signals of the control device are collected. An accelerator dial 41 serving as engine speed setting means for indicating an set engine speed, an engine speed sensor 42 for detecting an actual engine speed Ne, a front pump pressure sensor 43 and a rear pump pressure sensor 44 serving as main pump pressure sensors for detecting each of a front pump pressure Ppf and a rear pump pressure Ppr which are pump pressures of the front pump 7 and the rear pump 8, a front pump swash plate angle sensor 45 and a rear pump swash plate angle sensor 46 serving as main pump capacity sensors for detecting each capacity of pumps from a front pump swash plate angle $\phi f$ of the front pump 7 which is a swash plate type variable capacity pump and a rear pump swash plate angle $\phi r$ of the rear pump 8 which is a swash plate type variable capacity pump, a main accumulator pressure sensor 47 for detecting a main accumulator pressure Pa1 of the main accumulator 17, a sub-accumulator pressure sensor 48 for detecting a sub-accumulator pressure Pa2 of the sub-accumulator 18, and an assist pump pressure sensor 49 for detecting an assist pump discharge pressure Pa3 of assist pressure oil discharged from the assist pump 16 are connected to an input side of a controller 40.

As shown in FIG. 1, the engine speed sensor 42, the front pump pressure sensor 43, the rear pump pressure sensor 44, the front pump swash plate angle sensor 45, the rear pump swash plate angle sensor 46, the main accumulator pressure sensor 47, the sub-accumulator pressure sensor 48, and the assist pump pressure sensor 49 are installed.

Meanwhile, the swash plate control device 16*a* of the assist pump 16, the main accumulator regeneration valve 25, the unloading valve 26, and the power shift control valve 32 which are controlled by the controller 40 are connected to an output side of the controller 40.

Next, an operation of a power regeneration circuit will be described with reference to FIGS. 1, 7, and 8.

I. Explanation of Operation of Hydraulic Circuit

(1) Charge Operation of Accumulator

A charge operation of an accumulator will be described with reference to FIGS. 1 and 7.

In FIG. 1, if a lever is operated to lower a boom, a pilot pressure for lowering a boom is output from a pilot operation circuit including an operating lever interlocking type proportional pressure reducing valve (not shown), and according to the pilot pressure for lowering a boom, the first boom flow rate control valve 10 is switched from an a chamber to a b chamber, the boom regeneration valve 12 is switched from an a chamber from a b chamber, the selector valve 19 is switched from an a chamber a to a b chamber, and the boom regeneration selector valve 21 is switched from an a chamber to a b chamber.

Accordingly, while pressure oil is supplied from the front pump 7 to rod chambers of the first boom cylinder 3*a*1 and the second boom cylinder 3*a*2 via the chamber b of the first boom flow rate control valve 10, a portion between the head chamber of the first boom cylinder 3*a*1 and the head chamber of the second boom cylinder 3*a*2 is interrupted by the selector valve 19, most of the pressure oil in the head chamber of the first boom cylinder 3*a*1 is returned to the rod chambers of the first and second boom cylinders 3*a*1 and 3*a*2 via the boom regeneration valve 12, and a portion of the pressure oil of the head chamber is opened to the hydraulic oil tank 34 via the chamber b of the first boom flow rate control valve 10.

Figure 7:
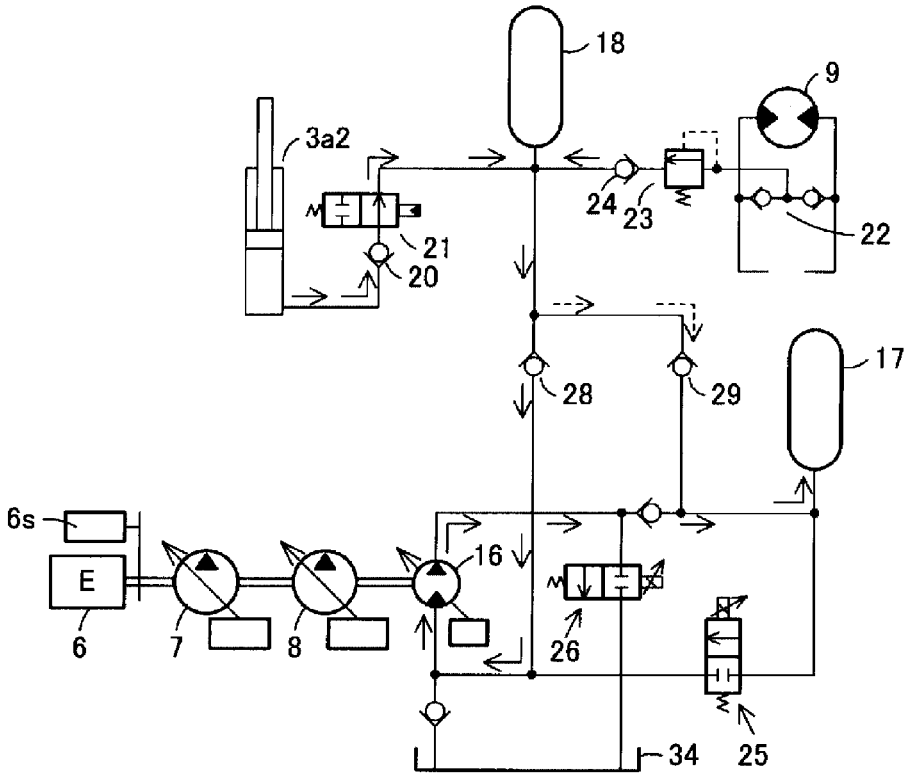
FIG. 7 is a circuit diagram explaining a charge operation of an accumulator in the assist device.

In this case, as shown in FIG. 7, pressure oil in the head chamber of the second boom cylinder 3*a*2 is introduced into the sub-accumulator 18 via the boom head pressure accumulation check valve 20 and the boom regeneration selector valve 21. In addition, when swivel braking is applied, pressure oil is introduced into the sub-accumulator 18 side via the high pressure selection valve 22, the sequence valve 23, and the swivel pressure accumulation check valve 24.

As shown in FIG. 7, the pressure oil introduced into the sub-accumulator 18 side is supplied to an inlet of the assist pump 16. When pressure accumulation has not been performed in the main accumulator 17, the unloading valve 26 is closed, and the pressure oil pressurized by the assist pump 16 is introduced into the main accumulator 17 so as to be pressure-accumulated. When a pressure of the main accumulator 17 reaches the maximum pressure, the unloading valve 26 is opened, and a discharge side of the assist pump 16 is opened to the hydraulic oil tank 34.

In this case, when a flow rate of the pressure oil introduced into the sub-accumulator 18 side is greater than a suction flow rate of the assist pump 16, the pressure oil is temporarily pressure-accumulated in the sub-accumulator 18. In addition, when a pressure of the main accumulator 17 is lower than a pressure of the sub-accumulator 18, the pressure oil is directly pressure-accumulated in the main accumulator 17 via the inter-accumulator check valve 29.

In addition, in FIG. 1, if a boom is operated to be lifted, a pilot pressure for lifting a boom is output from the pilot operation circuit to the first and second flow rate control valves 10 and 11 of a boom, and according to the pilot pressure for lifting a boom, the first boom flow rate control valve 10 is switched from the a chamber to a c chamber, the second boom flow rate control valve 11 is switched from an a chamber to a b chamber, and a large flow rate of pressure oil is supplied from the front pump 7 and the rear pump 8 to the head chambers of the boom cylinders 3*a*1 and 3*a*2.

(2) Engine Assist Operation

An engine assist operation will be described with reference to FIG. 8. When load torque of the engine 6 is high, the main accumulator regeneration valve 25 is open, pressure oil pressure-accumulated in the main accumulator 17 is supplied to an inlet of the assist pump 16, and the unloading valve 26 connected to the outlet of the assist pump 16 is open.

Accordingly, the assist pump 16 is operated as a hydraulic motor and assists the engine 6. Torque of assist is adjusted by controlling the swash plate of the assist pump 16 using a swash plate control device 16*a* based on a pressure of the main accumulator 17. The details will be described below.

II. Explanation of Engine Assist Control

Figure 9:
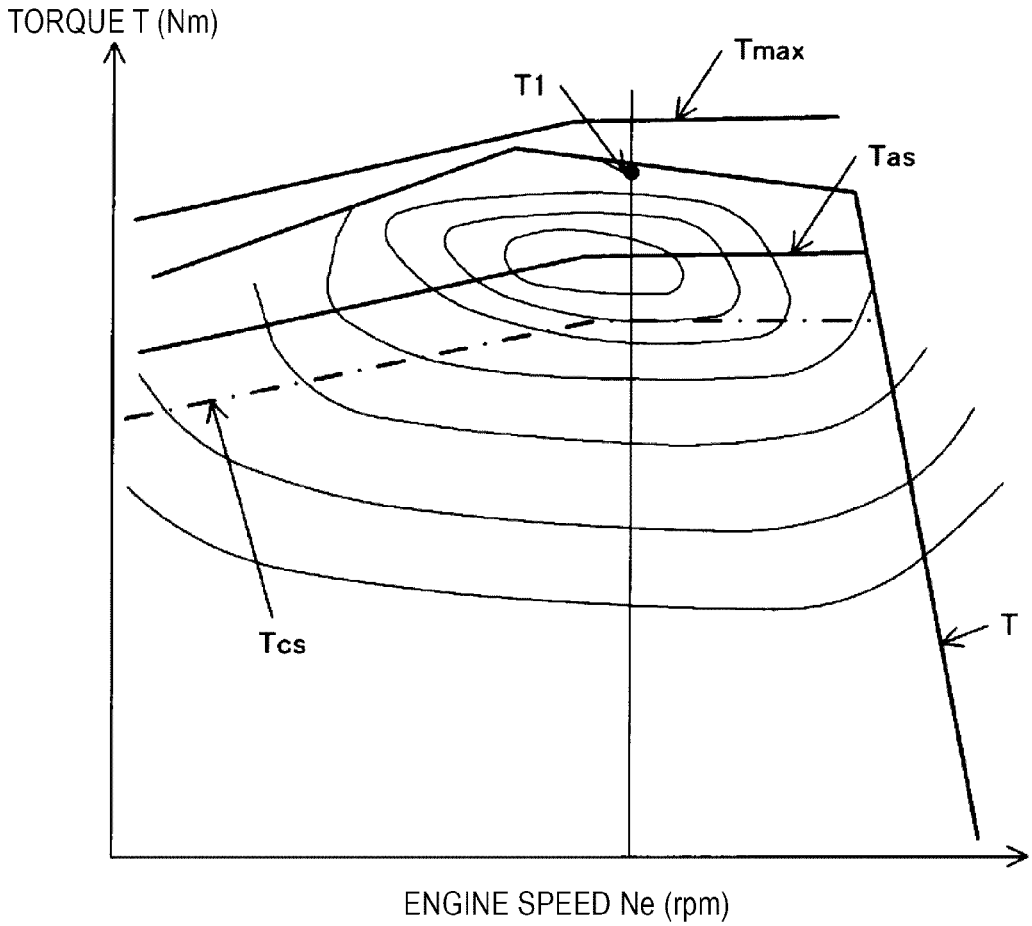
FIG. 9 is a characteristic diagram relating to an engine speed and torque for explaining an assist control in the assist device.
Figure 10:
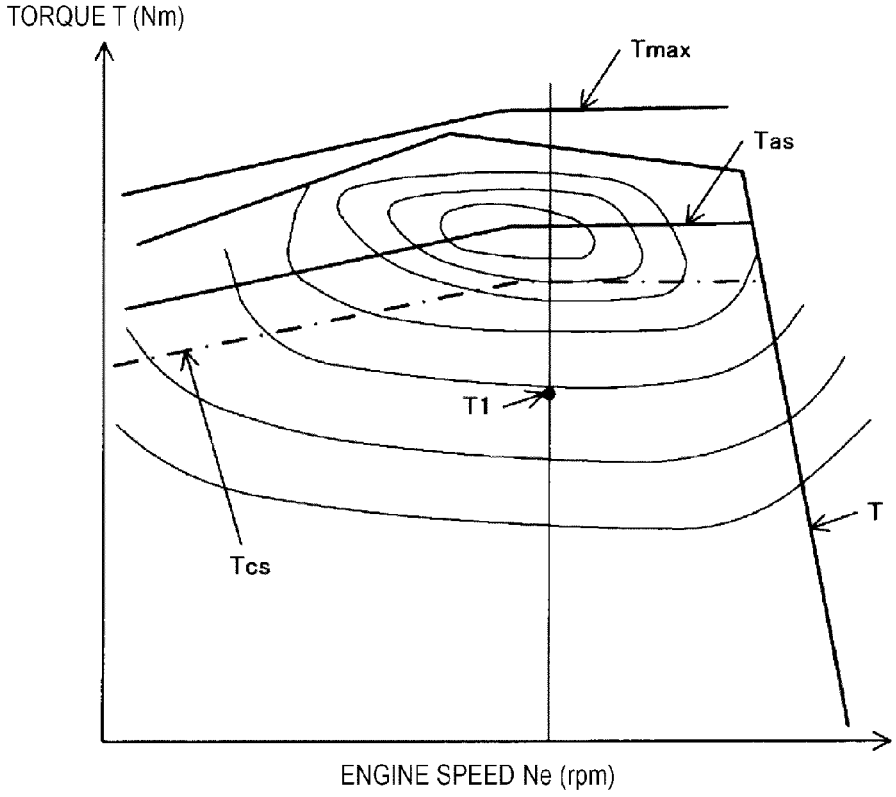
FIG. 10 is a characteristic diagram relating to an engine speed and torque for explaining a charge control in the assist device.

An engine assist control will be described with reference to FIG. 4 which is a control flowchart, FIG. 5 which is a control block diagram of an assist control task, FIG. 6 which is a control block diagram of a charge control task, FIG. 9 which is a characteristic diagram explaining an assist control, and FIG. 10 which is a characteristic diagram explaining a charge control. In FIGS. 9 and 10, T indicates an engine torque curve, Tmax indicates maximum output torque, Tas indicates assist starting torque, Tcs indicates charge starting torque, and T1 indicates engine load torque.

(1) Overall Control Flow

An overall control flow will be described with reference to the control flowchart of FIG. 4.

Figure 4:
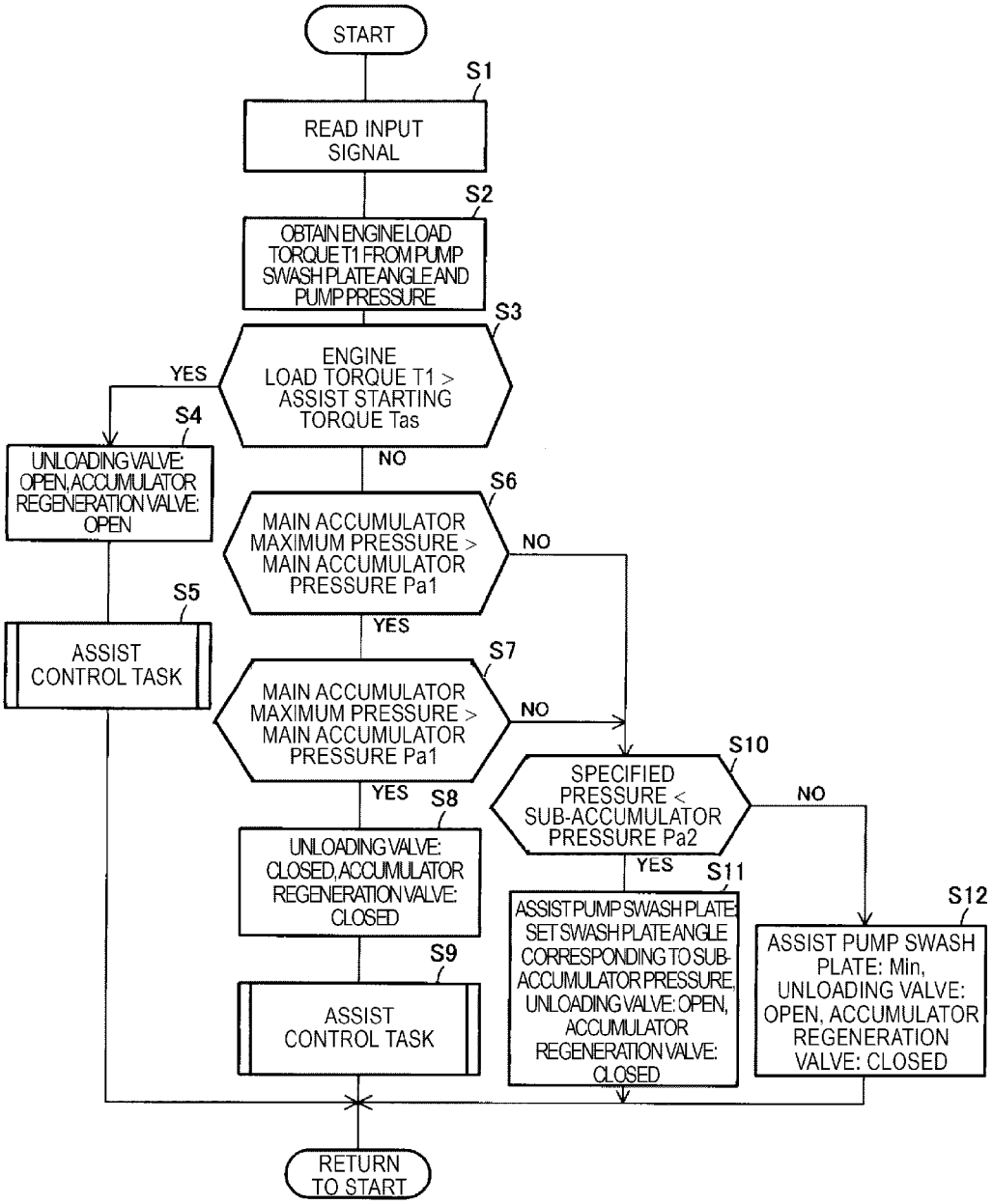
FIG. 4 is a control flowchart of the assist device.

In FIG. 4, the input signals shown in FIG. 3 are read by a processor S1. Subsequently, using a processor S2 serving as load torque calculation means, the engine load torque T1 is calculated according to the following Expression based on the front pump swash plate angle ϕf detected by the front pump swash plate angle sensor 45, the front pump pressure Ppf detected by the front pump pressure sensor 43, the rear pump swash plate angle ϕr detected by the rear pump swash plate angle sensor 46, and the rear pump pressure Ppr detected by the rear pump pressure sensor 44.

$$T1=\{Ppf\cdot\phi f\cdot Dp+Dpr\cdot\phi r\cdot Dp\}/2\pi$$

Dp: pump maximum capacity of each of main pumps 7 and 8

The engine load torque T1 and the assist starting torque Tas are compared with each other using a determinator S3. As shown in FIG. 9, the assist starting torque Tas is set by the accelerator dial 41.

Figure 8:
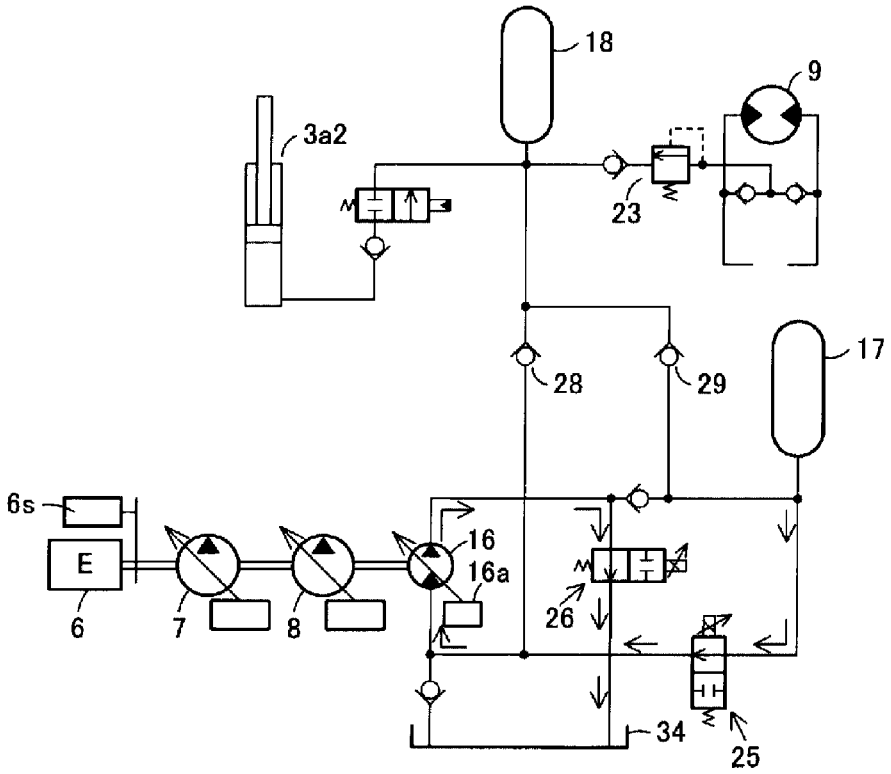
FIG. 8 is a circuit diagram explaining an engine assist operation in the assist device.

As shown in FIG. 9, when the engine load torque T1 is greater than the assist starting torque Tas, the processing moves from the determinator S3 to a processor S4, and as shown in FIG. 8, the main accumulator regeneration valve 25 is opened, and the unloading valve 26 is opened. Next, the processing moves from the processor S4 to an assist control task of a processor S5, and an assist control described below is performed.

When the engine load torque T1 is not greater than the assist starting torque Tas in the determinator S3, the processing moves from the determinator S3 to a determinator S6, and a pressure (main accumulator pressure Pa1) of the main accumulator 17 is determined. When the main accumulator pressure Pa1 does not reach the maximum pressure of the main accumulator (Yes), the engine load torque T1 and the charge starting torque Tcs are compared with each other using a determinator S7. As shown in FIG. 10, the charge starting torque Tcs is set by the accelerator dial 41.

As shown in FIG. 10, when the engine load torque T1 is smaller than the charge starting torque Tcs, the processing moves from the determinator S7 to a processor S8, and as shown in FIG. 7, the unloading valve 26 is opened, and the main accumulator regeneration valve 25 is closed. Subsequently, the processing moves from the processor S8 to a charge control task of a processor S9, and a charge control described below is performed.

When these find that conditions are not satisfied by the determinator S6 and the determinator S7, a pressure (sub-accumulator pressure Pa2) of the sub-accumulator 18 is determined using a determinator S10. When the sub-accumulator pressure Pa2 exceeds a specified pressure, in a processor S11, the unloading valve 26 is opened, the main accumulator regeneration valve 25 is closed, a swash plate angle of the assist pump 16 is adjusted according to the sub-accumulator pressure Pa2, the assist pump 16 is driven by the pressure oil of the sub-accumulator 18, and the pressure oil of the sub-accumulator 18 is opened while assisting the engine 6.

In the determinator S10, when the sub-accumulator pressure Pa2 is less than or equal to the specified pressure, in a processor S12, the swash plate angle of the assist pump 16 is controlled to be the minimum value, the unloading valve 26 is opened, and the main accumulator regeneration valve 25 is closed.

(2) Assist Control Task

Figure 5:
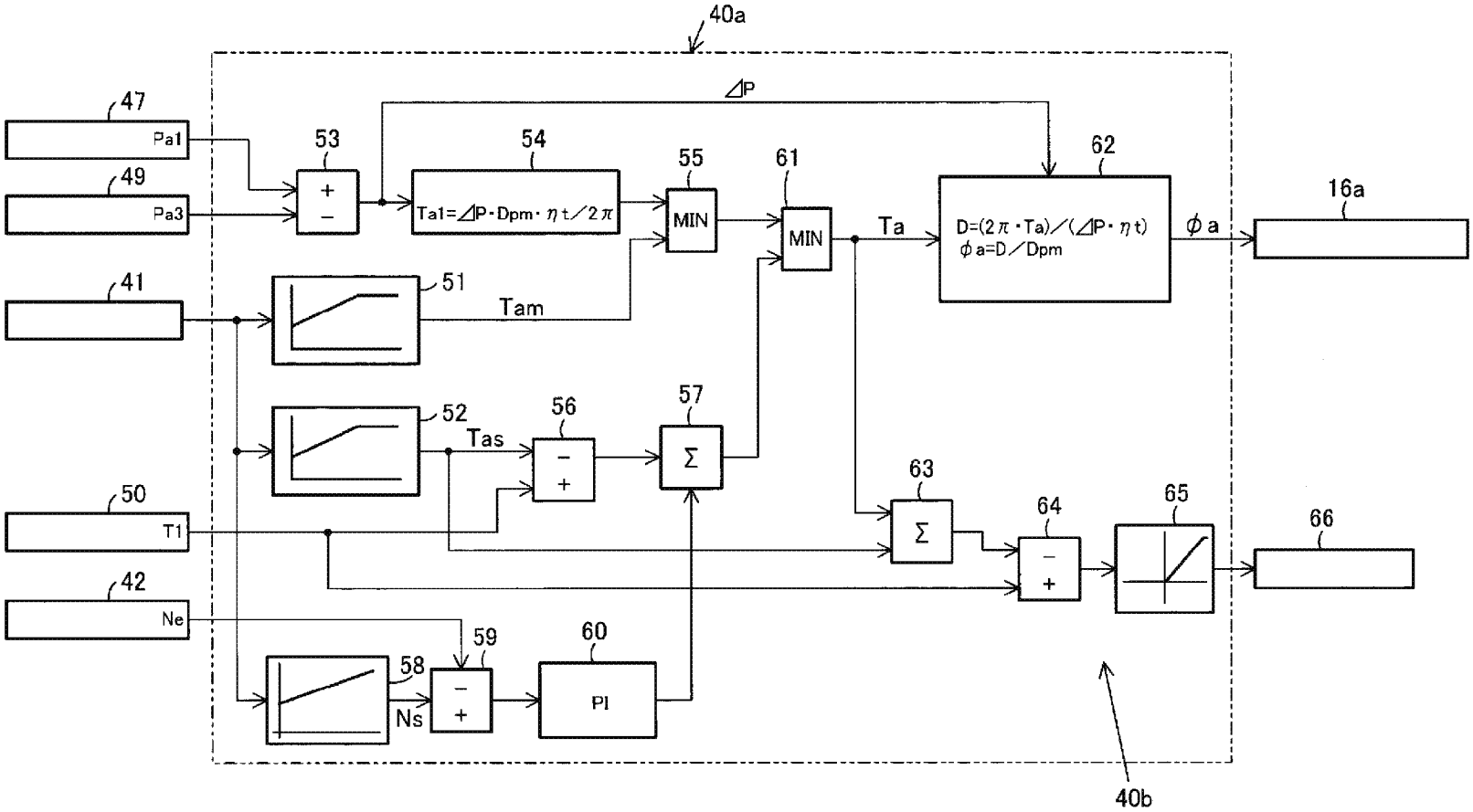
FIG. 5 is a control block diagram showing an assist control task in the control flowchart of FIG. 4.

As shown in FIG. 5, in a control block diagram of an assist control task including assist control means 40*a*, a reference numeral 50 indicates a calculator serving as load torque calculation means which calculates the engine load torque T1 using the processor S2 of the control flowchart of FIG. 4.

A maximum assist torque Tam is set by a function table 51 and an assist starting torque Tas is set by a function table 52 based on a numerical value set by the accelerator dial 41.

A differential pressure ΔP between the main accumulator pressure Pa1 detected by the main accumulator pressure sensor 47 and the assist pump discharge pressure Pa3 detected by the assist pump pressure sensor 49 is obtained by a subtracter 53. In addition, from the differential pressure ΔP, an assist torque Ta1 capable of being output from the assist pump 16 functioning as a hydraulic motor is obtained using the main accumulator pressure Pa1 according to the following calculation equation using a torque calculator 54, the assist torque Ta1 and the maximum assist torque Tam are compared with each other by a minimum value selector 55, and a smaller torque is selected and output.

Moreover, when assist is performed, as shown in FIG. 8, since a discharge side of the assist pump 16 is open to the hydraulic oil tank 34 via the unloading valve 26, the assist pump discharge pressure Pa3 is substantially 0, and differential pressure ΔP=main accumulator pressure Pa1 may be satisfied.

$$Ta1=\Delta P\cdot Dpm\cdot\eta t/2\pi$$

Dpm: pump maximum capacity of assist pump 16

ηt: torque efficiency

Meanwhile, a difference between the engine load torque T1 obtained by the processor S2 in the control flowchart of FIG. 4 and the assist starting torque Tas set by the function table 52 based on a numerical value set by the accelerator dial 41 is obtained by a subtracter 56, and the difference is input to an adder 57.

In addition, a deviation between the set engine speed Ns set by a function table 58 based on a numerical value indicated by the accelerator dial 41 and the actual engine speed Ne detected by the engine speed sensor 42 is obtained by a subtracter 59, a proportional integral control (PI control) is performed on the deviation by a PI control calculator 60, an output of the PI control is input to the adder 57, and addition is performed on the output from the subtracter 56 by the adder 57.

An output of the adder 57 and a torque limitation value output from the minimum value selector 55 are compared with each other by a minimum value selector 61, and a smaller value is input to an assist pump swash plate angle calculator 62 as a required assist torque Ta. In addition, a required assist pump capacity D is calculated by the following calculation equation, the swash plate angle ϕa of the assist pump 16 is obtained from a ratio of the required assist pump capacity D to an assist pump maximum capacity Dpm, and the swash plate control device 16*a* of the assist pump 16 perform control in order to obtain the swash plate angle ϕa.

$$D=(2\pi Ta)/(\Delta P\cdot\eta t)$$

$$\phi a=D/Dpm$$

D: required assist pump capacity

Dpm: assist pump maximum capacity

ηt: torque efficiency

In addition, as shown in FIG. 5, in main pump correction means 40*b*, an adder 63 adds the required assist torque Ta obtained by the minimum value selector 61 to the assist starting torque Tas, a subtracter 64 subtracts an output of the adder 63 from the engine load torque T1 calculated by the calculator 50, a plus value is extracted by a lower limiter 65, and a main pump correction torque is obtained by a calculator 66.

The main pump correction torque is input to a main pump torque controller (not shown), and driving torque of the main pump (front pump 7 and rear pump 8) is corrected by the power shift control valve 32.

According to the above-described effects, when the engine load torque T1 is greater than the assist starting torque Tas, the swash plate angle of the assist pump 16 is adjusted based on the main accumulator pressure Pa1 or the like and the engine 6 is assisted, and when the assist torque Ta1 of the assist pump 16 is not sufficient, driving torque of the main pump (front pump 7 and rear pump 8) is corrected.

(3) Charge Control Task

Figure 6:
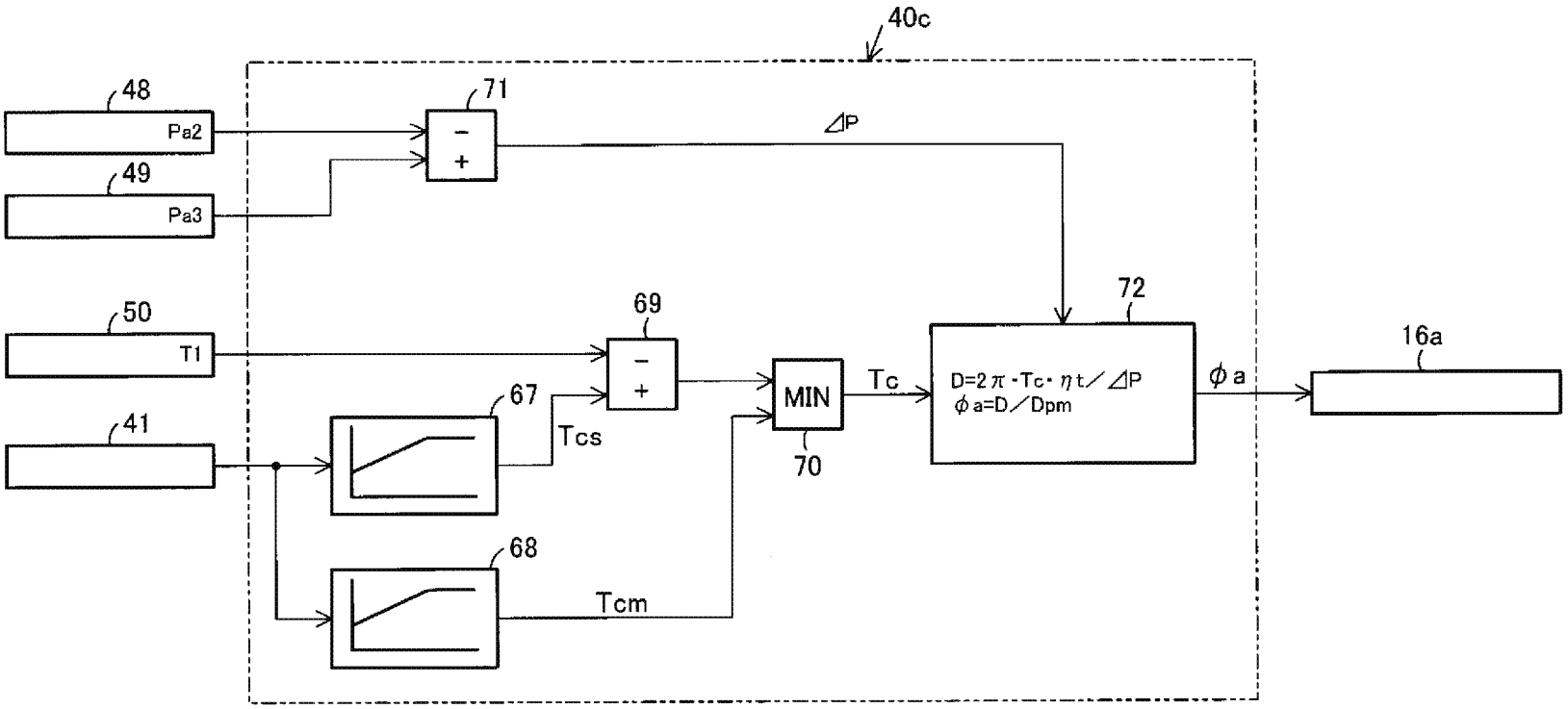
FIG. 6 is a control block diagram showing a charge control task in the control flowchart of FIG. 4.

As shown in FIG. 6, in a control block diagram of a charge control task having charge control means 40*c*, a charge starting torque Tcs is set based on the accelerator dial 41 by a function table 67, and maximum charge torque Tcm is set based on the accelerator dial 41 by a function table 68.

A difference between the engine load torque T1 obtained by the processor S2 of the control flowchart of FIG. 4 and the charge starting torque Tcs is obtained by a subtracter 69, this difference and the maximum charge torque Tcm are compared with each other by the minimum value selector 70, and torque having a smaller value is output as required charge torque Tc.

Meanwhile, in a subtracter 71, a difference ΔP between the assist pump discharge pressure Pa3 detected by the assist pump pressure sensor 49 and the sub-accumulator pressure Pa2 detected by the sub-accumulator pressure sensor 48 is obtained, the differential pressure ΔP and the required charge torque Tc are input to the assist pump swash plate angle calculator 72, the required assist pump capacity D is calculated according to the following calculation equation, the swash plate angle ϕa of the assist pump 16 is obtained from a ratio of the required assist pump capacity D to the assist pump maximum capacity Dpm, and the swash plate control device 16*a* of the assist pump 16 performs control in order to obtain the swash plate angle ϕa.

$$D=2\pi\cdot Tc\cdot\eta t/\Delta P$$

$$\phi a=D/Dpm$$

D: required assist pump capacity

Dpm: assist pump maximum capacity

ηt: torque efficiency

According to the above-described effects, since the main accumulator 17 is charged while torque of the assist pump 16 is controlled based on the required charge torque Tc, it is possible to prevent an overload of the engine 6.

Next, effects of the shown embodiment will be collectively described.

The variable capacity type assist pump 16 having a motor function for assisting an engine and a pump function for achieving pressure accumulation in the accumulator is directly connected to the engine 6 or the output shaft of the main pumps 7 and 8, and by the sub-accumulator 18 which temporarily pressure-accumulates an intermediate-pressure return pressure oil flowing out from the boom cylinder 3*a* and the swivel motor 9 and is different from the main accumulator 17 accumulating high-pressure hydraulic energy of oil discharged from the assist pump 16, the return pressure oil is supplied to the inlet of the assist pump 16 and the main accumulator 17. When the engine load torque T1 obtained from the front pump pressure Ppf, the rear pump pressure Ppr, the front pump swash plate angle ϕf, and the rear pump swash plate angle ϕr exceeds the assist starting torque Tas, the controller 40 calculates the assist pump swash plate angle ϕa of the assist pump 16 based on the difference in torque between the engine load torque T1 and the assist starting torque Tas and the differential pressure (assist pump discharge pressure Pa3 may be 0) between the main accumulator pressure Pa1 and the assist pump discharge pressure Pa3, and controls the assist pump swash plate angle ϕa. In addition, the controller pressurizes the pressure-accumulated oil from the main accumulator 17 and supplies the pressure-accumulated oil to the inlet of the assist pump 16, and drives the assist pump 16 as a motor to assist the engine 6. Moreover, when the engine load torque T1 is lower than the charge starting torque Tcs, the controller calculates and controls the assist pump swash plate angle ϕ based on the difference in torque between the engine load torque T1 and the charge starting torque Tc and the differential pressure between the assist pump discharge pressure Pa3 and the sub-accumulator pressure Pa2, and pressure-accumulates the pressure oil supplied from the assist pump 16 in the main accumulator 17. Accordingly, it is possible to provide an inexpensive engine assist device capable of performing stable energy regeneration from the main accumulator 17 or the sub-accumulator 18 according to a pressure accumulation state of the main accumulator 17, a state of the engine load torque T1, or the like without using a large capacity generator motor, a large capacity power storage device, or the like.

In addition, since the engine 6 is assisted by the assist pump 16 driven as a hydraulic motor by the main accumulator pressure Pa1 during a high load of the engine 6, and the pressure oil stably supplied from the boom cylinder 3*a* and the swivel motor 9 through pressure average effects of the sub-accumulator 18 during a low load of the engine 6 is pressure-accumulated in the main accumulator 17 by the assist pump 16, a load of the engine 6 can be averaged, fuel consumption is improved, and it is possible to decrease exhaust gas such as black smoke generated from the engine 6.

The controller 40 includes the assist control means 40*a* for assisting the engine 6 when the engine load torque T1 exceeds the assist starting torque Tas set by the accelerator dial 41, the main pump correction means 40*b* for correcting torque of the front pump 7 and the rear pump 8 when the assist torque Ta1 is not sufficient, and the charge control means 40*c* for pressure-accumulating pressure oil in the main accumulator 17 when the engine load torque T1 decreases, and the controller 40 controls the assist pump 16, the front pump 7, and the rear pump 8 while controlling opening and closing of the main accumulator regeneration valve 25 and the unloading valve 26 according to the engine load torque T1. Accordingly, it is possible to charge the pressure oil, in which pressure variation is smoothed by the sub-accumulator 18, into the main accumulator 17 at an appropriate timing according to a pressure accumulation state of the main accumulator 17, a state of the engine load torque T1, or the like, and it is possible to extract pressure oil energy for driving the assist pump 16 from the main accumulator 17 or the sub-accumulator 18 at an appropriate timing.

Since the main accumulator regeneration valve 25 and the unloading valve 26 are opened to be interlocked with each other during starting of the starter motor of the engine 6, when the engine starts or when the engine restarts from an idling stop state, the assist pump 16 can function as an assist motor operated in a rotation direction of the engine by the pressure oil pressure-accumulated in the main accumulator 17. Accordingly, it is possible to decrease a load of the starter motor 6*s*, reduce a size of the starter motor 6*s*, decrease consumption of a battery, and decrease unpleasant gear noise generated when the starter motor is used.

Since the boom cylinder 3*a*, the swivel motor 9, the front pump 7, the rear pump 8, the assist pump 16, the main accumulator 17, the sub-accumulator 18, or the like configures a working machine of a hybrid system using a hydraulic system, as hydraulic devices, compared to a hybrid system using an electric system configured of a generator motor or a power storage device, it is possible to significantly decrease cost, decrease maintenance, and decrease running cost. In addition, the hydraulic device can be easily mounted on an existing hydraulic working machine.

In addition, since it is possible to effectively recover an intermediate-pressure return pressure oil, which is discharged from the boom cylinder 3*a* and the swivel motor 9, via the sub-accumulator 18 when the boom is lowered and swivel braking is performed, it is possible to decrease loss in energy in a hydraulic device which has been discharged as heat until now, it is possible to prevent a temperature of hydraulic oil from increasing, and it is possible to decrease a size of a hydraulic cooling device.

The pressure oil of the head chamber of the second boom cylinder 3*a*2 is returned to the sub-accumulator 18 side by the boom head pressure accumulation check valve 20 and the boom regeneration selector valve 21 only when the boom is lowered and is pressure-accumulated in the main accumulator 17. In addition, return oil having a pressure exceeding a swivel brake pressure is temporarily recovered by the sub-accumulator and can be pressure-accumulated in the main accumulator 17 while maintaining the swivel brake pressure generated when the right swivel braking or the left swivel braking is applied to the swivel motor 9, by the high pressure selection valve 22, the sequence valve 23, and the swivel pressure accumulation check valve 24, and it is possible to introduce a high pressure oil in the main accumulator 17 to the assist pump 16 in only a direction of being supplied to the inlet of the assist pump 16 by the assist pump inflow-side check valve 28, the inter-accumulator check valve 29, and the assist pump outflow-side check valve 30. Accordingly, it is possible to pressure-accumulate pressure oil pressurized by the assist pump 16 directly connected to the output shaft of the engine 6 in the main accumulator 17 in a high pressure state while smoothing pressure oil variation of the return pressure oil discharged from the head chamber of the second boom cylinder 3*a*2 when the boom is lowered and the return pressure oil discharged from the swivel motor 9 when swivel braking is applied, by the sub-accumulator 18. In addition, it is possible to effectively recover excess energy when a load of the engine 6 decreases and effectively use the excess energy when a load of the engine 6 increases and it is possible to decrease energy loss of a hydraulic device. Therefore, it is possible to reduce sizes of the engine 6 and a hydraulic cooling device, and it is possible to decrease sizes of related devices such as a cooling device or an air cleaner of the engine 6 according to reduction in a size of the engine. In addition, it is possible to effectively perform energy regeneration even with a small assist pump 16 using the high-pressure main accumulator 17 and the intermediate-pressure sub-accumulator 18.

INDUSTRIAL APPLICABILITY

The present invention provides industrial applicability for business persons in the manufacturing industry, selling, or the like of an engine assist device or a working machine.

REFERENCE SIGNS LIST

A: working machine
B: machine body
C: working device
1: lower traveling body
2: upper swivel body
3*a*: boom cylinder serving as fluid pressure actuator
6: engine
6*s*: starter motor
7: front pump serving as main pump
8: rear pump serving as main pump
9: swivel motor serving as fluid pressure actuator
16: assist pump
17: main accumulator
18: sub-accumulator
20: boom head pressure accumulation check valve
21: boom regeneration selector valve
22: high pressure selection valve
23: sequence valve
24: swivel pressure accumulation check valve
25: main accumulator regeneration valve
26: unloading valve
28: assist pump inflow-side check valve
29: inter-accumulator check valve
30: assist pump outflow-side check valve
40: controller
40*a*: assist control means
40*b*: main pump correction means
40*c*: charge control means
41: accelerator dial serving as engine speed setting means
42: engine speed sensor
43: front pump pressure sensor serving as main pump pressure sensor

44: rear pump pressure sensor serving as main pump pressure sensor

45: front pump swash plate angle sensor serving as main pump capacity sensor

46: rear pump swash plate angle sensor serving as main pump capacity sensor

47: main accumulator pressure sensor

48: sub-accumulator pressure sensor

49: assist pump pressure sensor

The invention claimed is:

1. An engine assist device in which a variable capacity type main pump is driven by an engine, excess energy generated when a fluid pressure actuator which is operated by a pressurized fluid discharged from the main pump is braked is accumulated in an accumulator, and energy is regenerated in the engine, the engine assist device comprising:

a variable capacity type assist pump which is directly connected to the engine or the main pump and has a motor function for assisting an engine and a pump function for accumulating a pressure in an accumulator;

a main accumulator which accumulates a pressurized fluid discharged from the assist pump;

a sub-accumulator which temporarily pressure-accumulates a return pressure oil flowing out from the fluid pressure actuator and supplies the return pressure oil to the assist pump and the main accumulator;

engine speed setting means for indicating a set engine speed;

an engine speed sensor for detecting an actual engine speed;

a main pump pressure sensor for detecting a main pump pressure during a discharging operation of the main pump;

a main pump capacity sensor which detects a variable capacity of the main pump;

a main accumulator pressure sensor which detects a main accumulator pressure of the main accumulator;

a sub-accumulator pressure sensor which detects a sub-accumulator pressure of the sub-accumulator;

an assist pump pressure sensor which detects an assist pump discharge pressure of a fluid discharged from the assist pump;

a controller which obtains an engine load torque from the main pump pressure and the capacity of the main pump, wherein when the engine load torque exceeds assist starting torque set by the engine speed setting means, the controller calculates and controls a capacity of the assist pump based on a difference in torque between the engine load torque and the assist starting torque and a differential pressure between the main accumulator pressure and the assist pump discharge pressure, and introduces a pressure-accumulated fluid discharged from the main accumulator into the assist pump, and when the engine load torque is lower than charge starting torque set by the engine speed setting means, the controller calculates and controls the capacity of the assist pump based on a difference in torque between the engine load torque and the charge starting torque and a differential pressure between the assist pump discharge pressure and the sub-accumulator pressure, and introduces a pressurized fluid discharged from the assist pump into the main accumulator.

2. The engine assist device according to claim 1, further comprising:

a main accumulator regeneration valve which is provided between the main accumulator and the assist pump, and pressurizes the pressure-accumulated fluid of the main accumulator and supplies the fluid to the assist pump by means of an opening operation; and an unloading valve which is connected to a fluid outflow side of the assist pump and is configured to open the fluid outflow side of the assist pump with respect to an operating fluid tank by means of an opening operation;

wherein the controller includes:

load torque calculation means for obtaining the engine load torque from the main pump pressure and the capacity of the main pump;

assist control means for opening the main accumulator regeneration valve and the unloading valve and for driving the assist pump by the main accumulator pressure when the engine load torque exceeds the assist starting torque set by the engine speed setting means, and for assisting the engine by calculating and controlling the capacity of the assist pump based on the difference in torque between the engine load torque and the assist starting torque and the differential pressure between the main accumulator pressure and the assist pump discharge pressure;

main pump correction means for obtaining assist torque configured to be outputted from the main accumulator pressure and correcting torque of the main pump when the assist torque is insufficient; and charge control means for driving the assist pump by closing the main accumulator regeneration valve and the unloading valve when the engine load torque is lower than the charge starting torque set by the engine speed setting means, and for pressure-accumulating an operating fluid in the main accumulator by calculating and controlling the capacity of the assist pump based on the difference in torque between the engine load torque and the charge starting torque and the differential pressure between the assist pump discharge pressure and the sub-accumulator pressure.

3. The engine assist device according to claim 2, wherein the engine includes a starter motor which is directly connected to the engine, and wherein the main accumulator regeneration valve and the unloading valve have a function by which the main accumulator regeneration valve and the unloading valve are opened to be interlocked with each other during starting of the starter motor.

4. A working machine, comprising:

a machine body;

a working device which is mounted on the machine body; and the engine assist device provided in the machine body and the working device, the engine assist device comprising a variable capacity type main pump is driven by an engine, excess energy generated when a fluid pressure actuator which is operated by a pressurized fluid discharged from the main pump is braked is accumulated in an accumulator, and energy is regenerated in the engine, the engine assist device comprising:

a variable capacity type assist pump which is directly connected to the engine or the main pump and has a motor function for assisting an engine and a pump function for accumulating a pressure in an accumulator;

a main accumulator which accumulates a pressurized fluid discharged from the assist pump;

a sub-accumulator which temporarily pressure-accumulates a return pressure oil flowing out from the fluid pressure actuator and supplies the return pressure oil to the assist pump and the main accumulator;

engine speed setting means for indicating a set engine speed;

an engine speed sensor for detecting an actual engine speed;

a main pump pressure sensor for detecting a main pump pressure during a discharging operation of the main pump;

a main pump capacity sensor which detects a variable capacity of the main pump;

a main accumulator pressure sensor which detects a main accumulator pressure of the main accumulator;

a sub-accumulator pressure sensor which detects a sub-accumulator pressure of the sub-accumulator;

an assist pump pressure sensor which detects an assist pump discharge pressure of a fluid discharged from the assist pump;

a controller which obtains an engine load torque from the main pump pressure and the capacity of the main pump, wherein when the engine load torque exceeds assist starting torque set by the engine speed setting means, the controller calculates and controls a capacity of the assist pump based on a difference in torque between the engine load torque and the assist starting torque and a differential pressure between the main accumulator pressure and the assist pump discharge pressure, and introduces a pressure-accumulated fluid discharged from the main accumulator into the assist pump, and when the engine load torque is lower than charge starting torque set by the engine speed setting means, the controller calculates and controls the capacity of the assist pump based on a difference in torque between the engine load torque and the charge starting torque and a differential pressure between the assist pump discharge pressure and the sub-accumulator pressure, and introduces a pressurized fluid discharged from the assist pump into the main accumulator;

wherein the fluid pressure actuator, the main pump, the assist pump, the main accumulator, and the sub-accumulator are hydraulic devices.

5. A working machine, comprising:

a machine body;

a working device which is mounted on the machine body; and a engine assist device provided in the machine body in which a variable capacity type main pump is driven by an engine, excess energy generated when a fluid pressure actuator which is operated by a pressurized fluid discharged from the main pump is braked is accumulated in an accumulator, and energy is regenerated in the engine, the engine assist device comprising:

a variable capacity type assist pump which is directly connected to the engine or the main pump and has a motor function for assisting an engine and a pump function for accumulating a pressure in an accumulator;

a main accumulator which accumulates a pressurized fluid discharged from the assist pump;

a sub-accumulator which temporarily pressure-accumulates a return pressure oil flowing out from the fluid pressure actuator and supplies the return pressure oil to the assist pump and the main accumulator;

engine speed setting means for indicating a set engine speed;

an engine speed sensor for detecting an actual engine speed;

a main pump pressure sensor for detecting a main pump pressure during a discharging operation of the main pump;

a main pump capacity sensor which detects a variable capacity of the main pump;

a main accumulator pressure sensor which detects a main accumulator pressure of the main accumulator;

a sub-accumulator pressure sensor which detects a sub-accumulator pressure of the sub-accumulator;

an assist pump pressure sensor which detects an assist pump discharge pressure of a fluid discharged from the assist pump;

a controller which obtains an engine load torque from the main pump pressure and the capacity of the main pump, wherein when the engine load torque exceeds assist starting torque set by the engine speed setting means, the controller calculates and controls a capacity of the assist pump based on a difference in torque between the engine load torque and the assist starting torque and a differential pressure between the main accumulator pressure and the assist pump discharge pressure, and introduces a pressure-accumulated fluid discharged from the main accumulator into the assist pump, and when the engine load torque is lower than charge starting torque set by the engine speed setting means, the controller calculates and controls the capacity of the assist pump based on a difference in torque between the engine load torque and the charge starting torque and a differential pressure between the assist pump discharge pressure and the sub-accumulator pressure, and introduces a pressurized fluid discharged from the assist pump into the main accumulator;

wherein the fluid pressure actuator, the main pump, the assist pump, the main accumulator, and the sub-accumulator are hydraulic devices;

wherein the machine body includes:

a lower traveling body; and an upper swivel body which is capable of being swiveled around the lower traveling body by a hydraulic swivel motor, wherein the working device includes a hydraulic boom cylinder which moves the working device up and down, wherein the sub-accumulator in the engine assist device has a function which temporarily pressure-accumulates pressure oil discharged from a head chamber of the boom cylinder when a boom is lowered and pressure oil discharged from the swivel motor when swivel braking is applied, and wherein the sub-accumulator includes:

a boom head pressure accumulation check valve which enables the pressure oil of the head chamber of the boom cylinder to flow in only a direction in which the pressure oil is returned to the sub-accumulator side when the boom is lowered;

a boom regeneration selector valve which is switched from a closed state to an open state to return pressure oil to the sub-accumulator via the boom head pressure accumulation check valve;

a high pressure selection valve which selects a high pressure when right swivel braking and left swivel braking of the swivel motor are applied;

a sequence valve which is provided on a downstream side of the high pressure selection valve and has a relief function;

a swivel pressure accumulation check valve which supplies the pressure oil via the sequence valve to the sub-accumulator side;

an assist pump inflow-side check valve which enables a fluid to flow from the sub-accumulator to a fluid inflow side of the assist pump;

an inter-accumulator check valve which enables a fluid to flow from the sub-accumulator to the main accumulator; and an assist pump outflow-side check valve which enables pressure oil discharged from the assist pump to flow in a direction in which the pressure oil is capable of being pressure-accumulated in the main accumulator.

* * * * *